United States Patent [19]

Kandou

[11] 3,972,095

[45] Aug. 3, 1976

[54] SLIDING CLASP FASTENER

[75] Inventor: Akiyoshi Kandou, Uozu, Japan

[73] Assignee: Yoshida Kogyo Kabushiki Kaisha, Japan

[22] Filed: Apr. 8, 1975

[21] Appl. No.: 566,063

Related U.S. Application Data

[63] Continuation of Ser. No. 403,955, Oct. 5, 1973, which is a continuation of Ser. No. 244,036, April 14, 1972.

[30] Foreign Application Priority Data

Apr. 20, 1971 Japan ..... 46-30709

[52] U.S. Cl. ..... 24/205.11 F

[51] Int. Cl.[2] ..... A44B 19/36

[58] Field of Search ..... 24/205.11 F, 205.11 R

[56] References Cited

UNITED STATES PATENTS

| | | | |
|---|---|---|---|
| 2,044,161 | 6/1936 | Forster | 24/205.11 F |
| 2,220,136 | 11/1940 | Marinsky | 24/205.11 F |
| 2,832,119 | 4/1958 | Neitlich | 24/205.11 F |
| 3,775,815 | 12/1973 | Johnston | 24/205.11 F |

*Primary Examiner*—Bernard A. Gelak
*Attorney, Agent, or Firm*—Robert E. Burns; Emmanuel J. Lobato; Bruce L. Adams

[57] ABSTRACT

A sliding clasp fastener is disclosed which is provided with a stop means at an end thereof for limiting the reciprocal movement of a sliding member. This stop means particularly adaptable at a top end of the fastener is comprised of an arcuately shaped prong extending on the base side of fastener elements and substantially flush with the plane of these fastener elements for engagement with a flanged portion of the slider.

3 Claims, 2 Drawing Figures

SLIDING CLASP FASTENER

This is a continuation of application Ser. No. 403,955, filed Oct. 5, 1973, which was a continuation of Ser. No. 244,036, filed Apr. 14, 1972.

This invention relates generally to a sliding clasp fastener and more particularly to such a fastener which is provided with means for preventing its sliding member from over-running or from being separated from the fastener.

Heretofore, there have been proposed various types of end stops for limiting the reciprocal movements of a slider along rows of fastener elements to open and close the fastener. These end stops are usually termed a "top end stop" or "bottom end stop" depending upon the position in which they are applied on the fastener.

The present invention is directed to the provision of a top end stop suitable for use on a sliding clasp fastener carrying interlocking fastener elements made of plastic filaments.

Prior to this invention, there were known top end stops made of a metal and having a "U"-shape or otherwise annular configuration which are mounted astride of an edge of each stringer tape embracing thereat some of the terminal fastener elements. These end stops are prone to become loose or displaced upon repeated abutment against the slider. Furthermore, since they are exposed for contact with the skin of the wearer, the metal stops would give the wearer a sort of uncomfortable extraneous feel.

More recent improvements comprise a strip of plastic material adhered to the leg portions of fastener elements at the upper terminal region of the element rows on the fastener in such a manner that the strip protrudes laterally on the base side of the elements. This type of top end stop has the disadvantages that its service life is limited because the protruding end of the strip, which is often accompanied with burrs, is liable to wear or separate from the fastener upon repeated impinging contact with the shoulders of the slider and that such burred strip would often catch not only a garment fabric but also the skin of the wearer.

It is an object of this invention to provide an improved stop means for use on a sliding clasp fastener having mounted thereon rows of fastener elements made of plastic filaments, which stop means will substantially eliminate the above-noted disadvantages of the conventional end stops.

Figure 1:
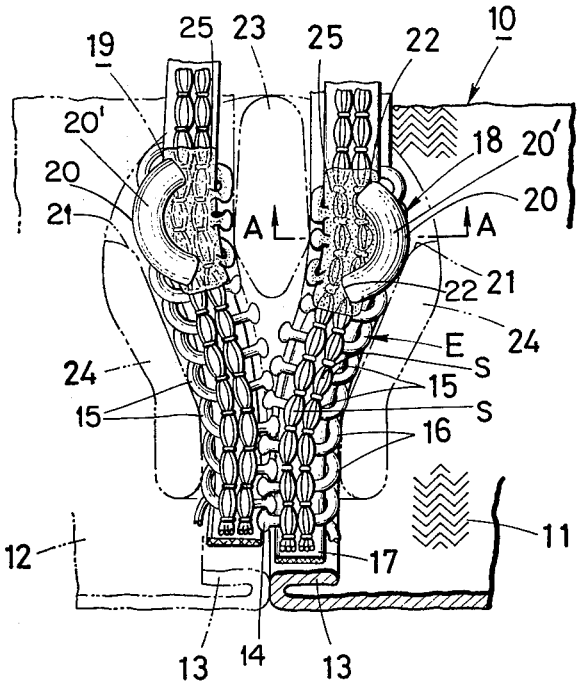
Figure 2:
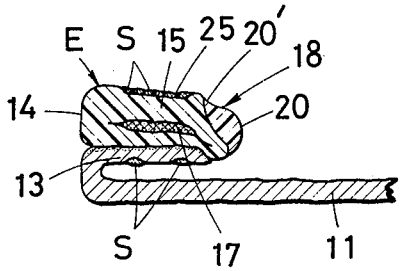

This and other objects and features of the invention will appear clear as the description proceeds with reference to a specific embodiment shown in the accompanying drawings in which:

FIG. 1 is a plan view, partly sectional, on enlarged scale of an important part of a sliding clasp fastener, and FIG. 2 is a cross-sectional view taken on the line A—A of FIG. 1.

For purposes of illustration, the invention will be described with reference to an embodiment in which its principles are applied to a sliding clasp fastener of the known concealed type as shown in FIG. 1. The fastener generally designated by the reference numeral 10 comprises a pair of opposed stringer tapes 11, 12 each carrying along their respective folded edge 13 a row of fastener elements E. The illustrated fastener elements E are made of a plastic filament formed into a coil in the known manner and are each comprised of a coupling head 14, legs 15 and a base portion 16. As seen, the row of these coil elements E is secured to twothread chain stitches S through a stiffening cord 17 onto the folded edge 13 of stringer tape 11.

Designated at 18 is a stop means embodying the present invention which is adapted as a top end stop for limitting thereat the upward movement of the slider 19. This end stop is made of a plastic material fusible with fastener elements E. Importantly, it has an arcuately shaped prong 20 extending on the base side of the elements E for engagement with the slider 19. More specifically, the arcuate prong 20 preferably round in cross section as seen in FIG. 2 provides a smooth contact surface for engagement with an inner side wall portion 21 of the flange 24 of the slider 19 so that the end stop 18 is held stable in position relative to the slider as seen in FIG. 1 and its frictional wear is minimized. Another important aspect of the invention is that both ends 22 of the end stop 18 are embedded in between adjacent fastener elements E and secured firmly in place by being fused as at 25 integrally with those elements E as by means of supersonic processing, so that the exposed surface 20' of the prong 20 lies substantially flush with the plane of the row of fastener elements E as better seen in FIG. 2. This will ensure a firm anchoring of the end stop 18 into position on the fastener, eliminating its tendency to become loose or detached upon repeated impinging contact with the slider as experienced with the conventional devices. It should be also noted that the end stop 18 being thus arranged will serve as a guide to align the terminal end of the fastener substantially in parallel with the side wall of the diamond 23 of the slider 19 as desired. Also advantageously, the end stop 18 lying flush with the surface of the row of elements E permits of the running of an ordinary presser foot over the fastener.

While the invention has been illustrated as applied to one of the two opposed stringer tapes, it will be obvious that the invention will be applied similarly to the other stringer in practice.

Having thus described the invention, it will be understood that various changes and modifications may be made in the specific form and construction herein advanced, without departing from the scope of the appended claims.

What is claimed is:

1. A sliding clasp fastener comprising: a pair of opposed stringer tapes each carrying along their respective marginal edge a row of plastic fastener elements each having a coupling head engageable between the coupling heads of two fastener elements on the other stringer tape and each having a base portion remote from said coupling head and jointly defining with said coupling head a given direction of each coupling element; a slider movable along the rows of fastener elements and having side flanges engageable with the base portions of the fastening elements in both stringer tapes to releaseably fasten together the coupling heads of the fastener elements on said opposed stringer tapes in response to movement of said slider in one direction and having a cam engageable with the fastened together coupling heads to unfasten same in response to movement of said slider in the other direction; and stop means for limiting the movement of said slider at an end of the fastener, said stop means comprising an arcuate stop member composed of plastic and extending along the respective base portions of a plurality of elements located at an end portion of each row of fastener elements and being directly fused to and forming part of the base portion of those elements so that said arcuate stop member extends in said given direction away from the base portions of those elements and has a thickness substantially equal to the thickness of the base portions of those elements adjacent said base portions and tapering in said given direction to a thickness less than the thickness of the base portion, of those elements and a solid portion terminating in a smooth and continuously extending contact surface engageable with an inner side wall of the flanges of the slider during movement thereof in said one direction to limit the movement of said slider.

2. A sliding clasp fastener as defined in claim 1 wherein said stop means is a top end stop having a rounded portion in cross section.

3. A sliding clasp fastener as defined in claim 1, wherein said stop means has a pair of ends each of which is fused integrally with the base portions of adjacent ones of said elements.

* * * * *